US005911370A

United States Patent [19]

Lusty

[11] Patent Number: 5,911,370

[45] Date of Patent: Jun. 15, 1999

[54] ROTARY MINERAL BREAKER TIP ASSEMBLY AND COMPONENTS THEREFOR

[75] Inventor: Andrew William Kevin Lusty, Matamata, New Zealand

[73] Assignee: Barmac Associates Limited, Matamata, New Zealand

[21] Appl. No.: 08/922,879

[22] Filed: Sep. 3, 1997

[30] Foreign Application Priority Data

Sep. 4, 1996 [NZ] New Zealand ..... 299299
Oct. 7, 1996 [NZ] New Zealand ..... 299518

[51] Int. Cl.[6] ..... B02C 13/09

[52] U.S. Cl. ..... 241/27; 241/275; 241/286; 241/287; 241/291

[58] Field of Search ..... 241/275, 291, 241/300, 27, 29, 286, 287

[56] References Cited

U.S. PATENT DOCUMENTS 3,258,211 6/1966 Behnke ..... 241/275
3,300,152 1/1967 Behnke et al. ..... 241/275
3,955,767 5/1976 Hise ..... 241/275
4,586,663 5/1986 Bartley ..... 241/197
4,834,298 5/1989 Murata et al. ..... 241/5
4,940,188 7/1990 Rodriguez et al. ..... 241/275

FOREIGN PATENT DOCUMENTS 2367535 10/1976 France .
WO 96/20789 7/1996 WIPO .

OTHER PUBLICATIONS

*Chemical Engineers Handbook 5th Edition,* Jul. 11, 1996, Hammer Mills, Perry & Chiltern McGraw, Hill, Inc. 1973, pp. 8–35 to 8–36.

*Primary Examiner*—John M. Husar
*Attorney, Agent, or Firm*—Kinney & Lange, P.A.

[57] ABSTRACT

An improvement relating to a rotary mineral breaker tip assembly and components therefor. A tip assembly is provided which presents an edge of a wear resistant tip which is able to be positioned within a rotary mineral breaker assembly by use of a position modifying means.

15 Claims, 9 Drawing Sheets

ROTARY MINERAL BREAKER TIP ASSEMBLY AND COMPONENTS THEREFOR

The present invention relates to improvements in or relating to a rotary mineral breaker tip assembly and components therefor.

In NZ248953 there is described the use of a tip assembly within a rotary mineral breaker. Such a tip assembly, of which a similar is also described in PCT/NZ94/00111, provides within the rotary mineral breaker a wear tip (preferably of tungsten carbide) over which material such as rock passes prior to leaving the rotor at a desired angle through an outlet or outlets. As well as providing a wear tip for the material to pass over, a retained bed of material is able to form against the tip assembly. The material thrown from the rotor hence also migrates across the retained bed of material prior to leaving the rotary mineral breaker.

The tip assembly described in NZ248953 is able to pivot relative to the rotary mineral breaker body which allows for the angle of the tip relative to the centre of the rotor to be adjusted to achieve an optimum exit path for the material which does not damage the exterior of the rotor. Because different materials have different flow paths such adjustability of the tip assembly allows for positioning of the tip to reduce the amount of wear on the rotor body.

Pivoting of the tip described in NZ248953 will however also change the profile of the surface of material retained by the tip assembly and the angle at which the material exiting the rotor flows relative to the wear tip. Therefore if the profile of retained material and the path of material leaving the rotor are at an optimum, but the tip is wearing rapidly due to the angle at which the material passes the tip, the tip angle would not be able to be changed without modifying the profile and material exit path.

It is therefore an object of the present invention to provide improvements in or relating to a rotary mineral breaker tip assembly and components therefor which will at least provide the public with a useful choice.

Accordingly in a first aspect the present invention broadly consists in or for a rotary mineral or rock ("mineral") breaker (hereinafter "rotary mineral breaker") of a kind that, in use, accumulates a bed of mineral pieces on a bed support of the rotor and against or inwardly of a tip assembly of the rotor and over which bed and tip assembly mineral pieces move to be free of the rotor, a rotor mounted or mountable said tip assembly, assemblage or combination comprising

- a wear resistant tip providing component or assembly to provide a wear resistant edge region over which the majority of the pieces in use being moved over the bed and then over the tip assembly tends or will tend to move, and
- position modifying means whereby as an assembly or assemblage the wear resistant tip providing component can be varied for subsequent use
  - (i) insofar as its angular disposition and hence its edge region is concerned across and under the mineral pieces to move there over, and
  - (ii) insofar the position of its edge region relative to the rotor axis is concerned, said position modifying means allowing, if desired, adjustment of either of (I) or (ii) or both to allow "tuning" of the tip assembly for the conditions of operation of the rotary mineral breaker. Preferably said edge region of said wear resistant tip providing component is straight or scalloped.

Preferably said wear resistant tip providing component comprises a first component or assembly (hereafter "first component") mounted or mountable, directly or indirectly, to define a part of the tip assembly, and a second component or assembly (hereafter "second component") to co-act with said first component in use as part of the tip assembly and to provide said weir-like edge region over which the majority of mineral pieces pass.

Preferably said first component defines at least two spaced edges which, as part of the tip assembly, extend or will extend above and delimit the extent of said weir-like edge of said second component with respect to mineral piece flow in use.

Preferably each of said spaced edges of said first component is wear resistant.

Preferably said position modifying means is adapted to receive said wear resistant tip providing component and to allow variable positioning, in use, of said wear resistant tip providing component with respect to said rotor of said rotary mineral breaker.

Preferably said position modifying means is at least one spacer to interpose between part of said rotor structure and said wear resistant tip providing component or assembly.

Preferably there is a plurality of said spacers and each can index to each other to allow different composite spacer assemblies to be defined.

In a further aspect the present invention consists in a position modifying means for the tip assembly of a rotary mineral or rock breaker of a kind that in use accumulates a bed of mineral pieces on a bed support of the rotor and against a tip assembly which tip assembly presents a weir-like (channelling or not) wear resistant tip (composite or not) to the flow of said mineral pieces prior to exiting the rotor, said position modifying means comprising multiple spacer members interposable in a number of different ways (involving differing numbers or choice(s) thereof) between said tip assembly and the rotor bed or an or any part of the rotor of said rotary mineral breaker so as to reposition said wear resistant tip for subsequent use

- (a) insofar as the angular disposition of said wear resistant tip relative to said rotor, and
- (b) insofar the position of said wear resistant tip relative to the rotor axis, to allow tuning of the tip assembly for the conditions of operation of the breaker.

Preferably position modifying means as claimed in claim 9 wherein each said spacer can index to another to allow different composite spacer assemblies to be defined.

Preferably Position modifying means wherein one of any assemblage of said spacers can index to a said tip assembly (composite or not).

In yet a further aspect the present invention consists in a rotary mineral or rock ("mineral") breaker (hereafter "rotary mineral breaker") of a kind that in use accumulates a bed of mineral pieces on a bed support of the rotor and against or inwardly of a tip assembly of the rotor and over which bed and tip assembly mineral pieces move to be free of the rotor

- wherein each tip assembly of or for each bed support of the rotor includes a component or assembly of wear resistant material providing a weir-like edge (straight, scalloped or otherwise) over and/or beyond which the majority of the mineral pieces are to move in exiting the rotor, said edge being adjustable in respect to
  - (1) its position relative to the rotor axis and
  - (2) the angular disposition of the weir-like edge relative to at least one of (a) the pathway of migration of pieces over and/or beyond said weir-like edge, (b) any substrate support for the bed of mineral or rock pieces and (c) the radius of the rotor, and
- if desired, the adjustments (1) and (2) can be achieved without adjustment of one necessarily resulting in a change of the other.

Preferably said weir-like edge adjustment is made or to be made using position modifying means as herein described or which results in a tip assembly, assemblage or combination as herein described.

In still a further aspect the present invention consists in a method of tuning a tip assembly of a rotary mineral breaker of a kind that, in use, accumulates a bed of mineral pieces on a bed support of the rotor and against or inwardly of a tip assembly of the rotor and over which bed and wear resistant edge region(s) of said tip assembly mineral pieces move to be free of the rotor, said method comprising spacing said rotor mounted or mountable said tip assembly using position modifying means whereby (i) the angular disposition of said tip assembly relative to the remainder of the rotor, or (ii) the distance of the tip assembly for the rotor axis, or (iii) both is adjusted to tune the tip assembly for the conditions of operation of the rotary mineral breaker.

In even a further aspect the present invention consists in an assembly being the rotary mineral breaker, adjustable wear tip assembly of such a breaker or any combination of the parts thereof substantially as hereinbefore described with reference to any one or more of the accompanying drawings.

Figure 3:
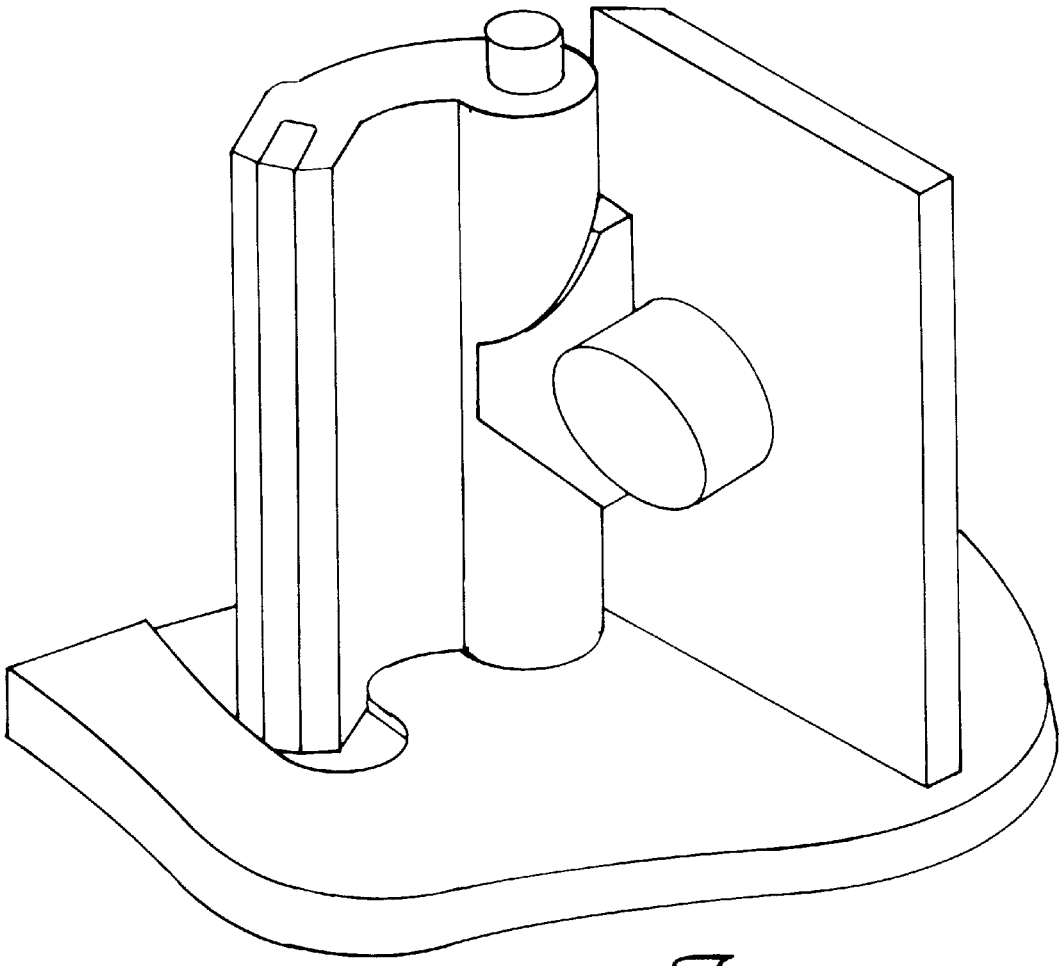
Fig. 3 PRIOR ART
FIG. 3 shows a tip assembly of NZ248953, the tip assembly being pivotal about an axis relative to the rotor embodiment.
Figure 8:
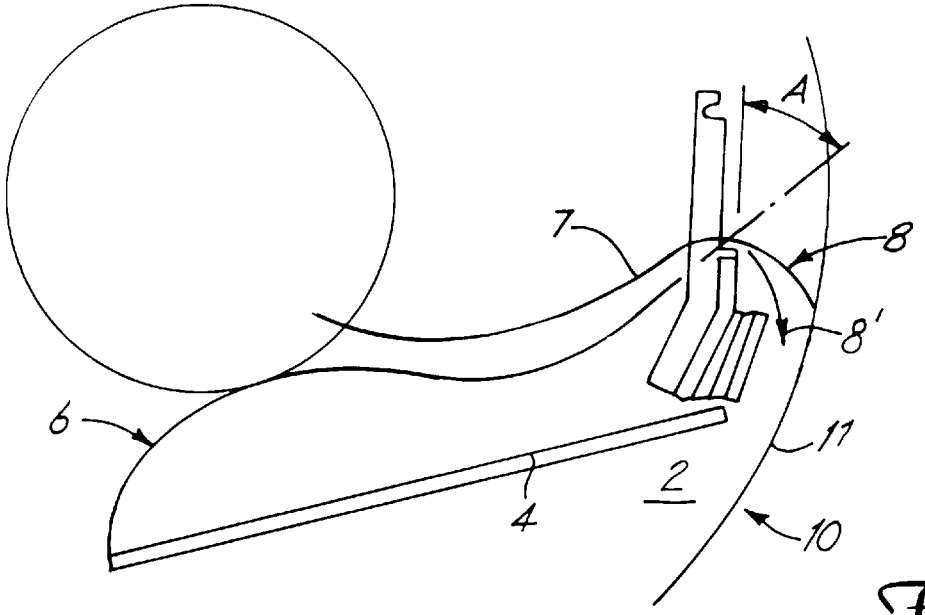
Figure 9:
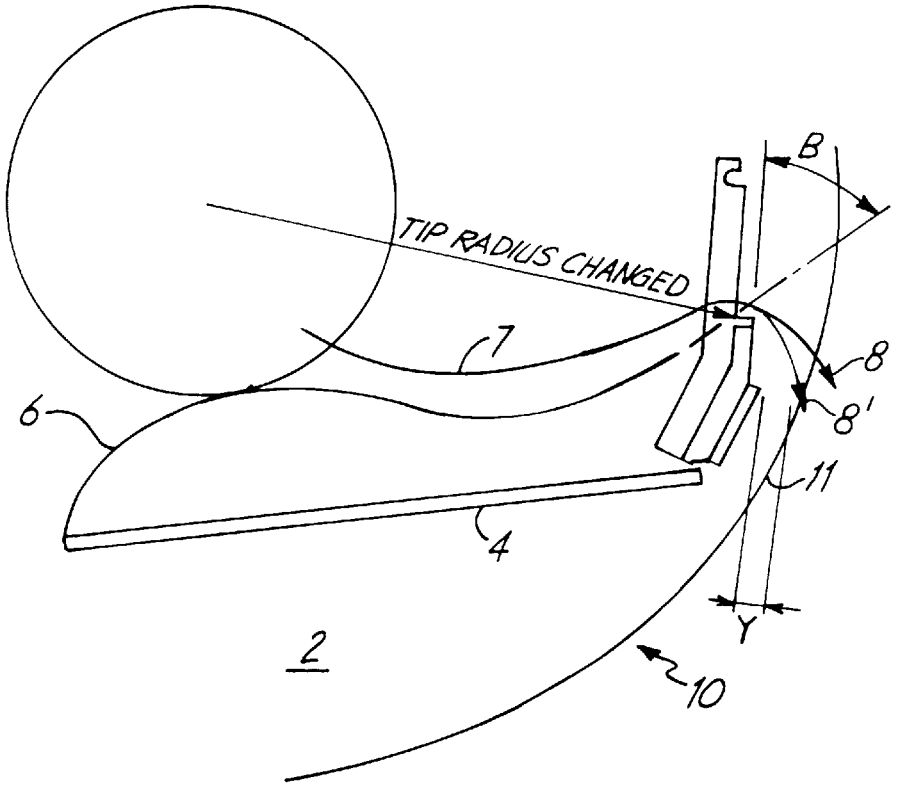
Figure 10:
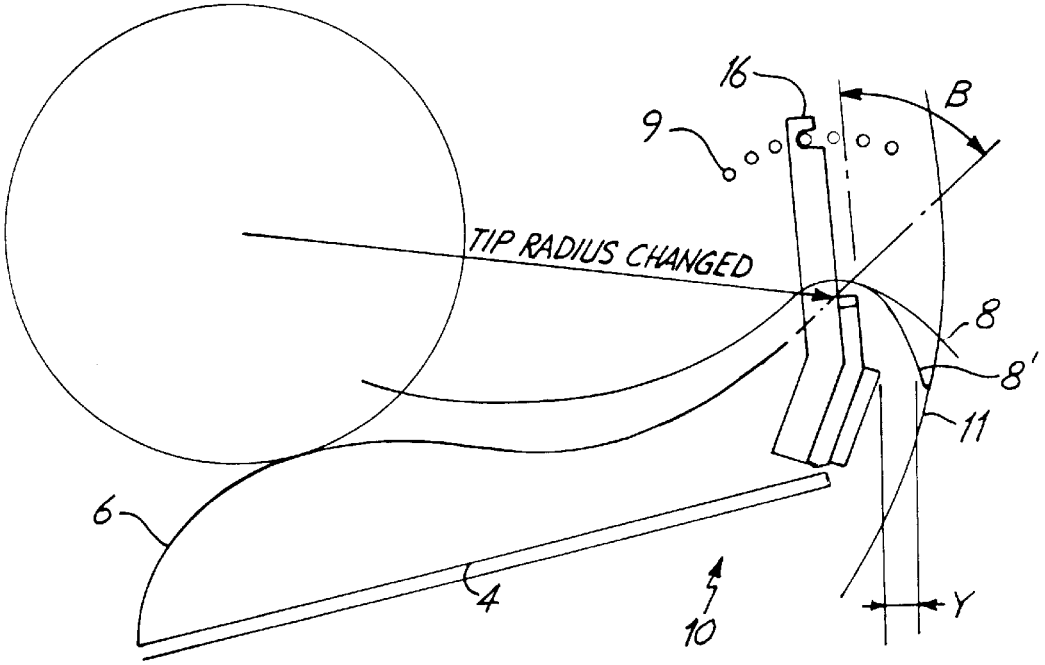
Figure 11:
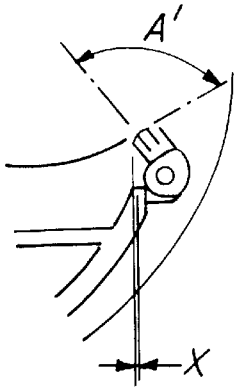
Fig. 11 PRIOR ART
Figure 12:
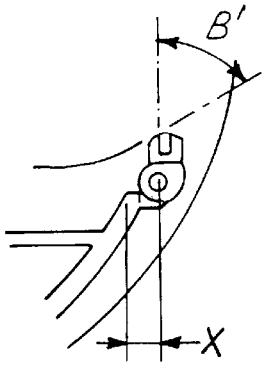
Fig. 12 PRIOR ART
Figure 13:
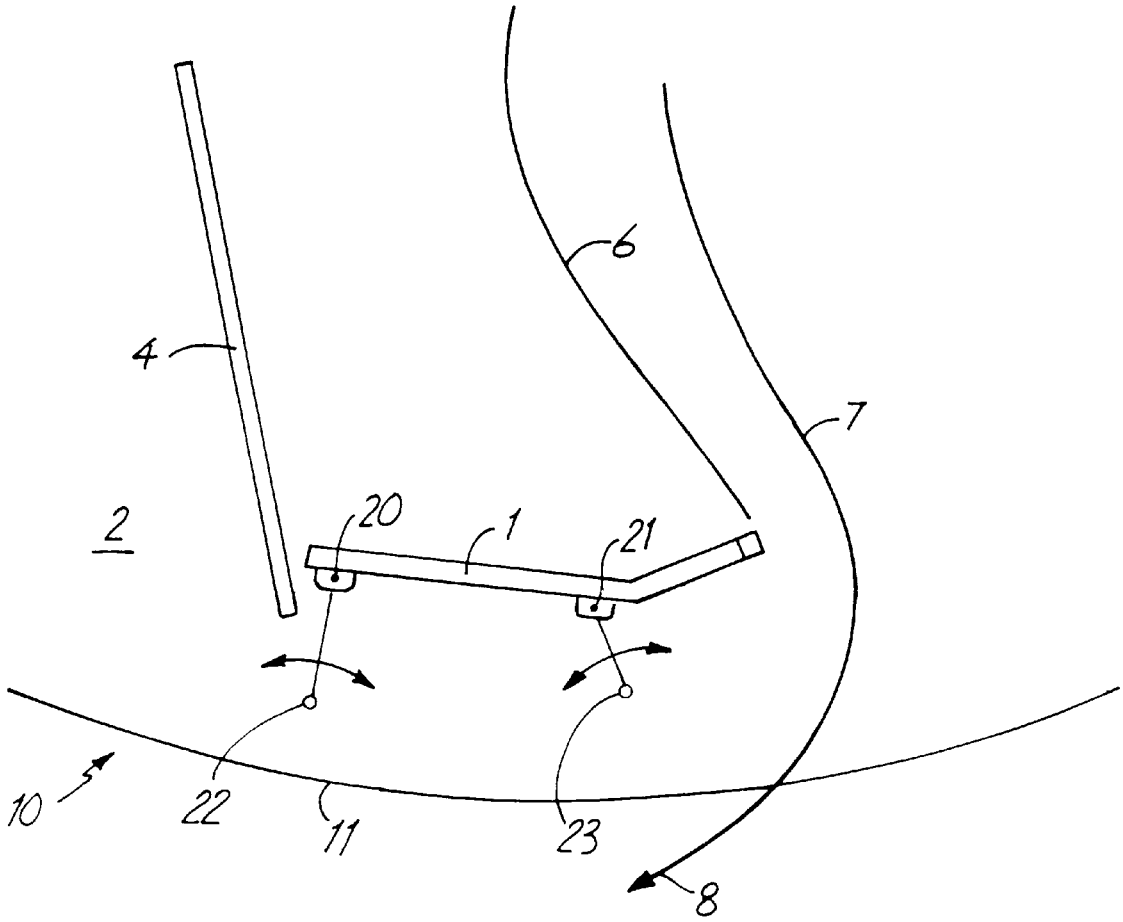
Figure 14:
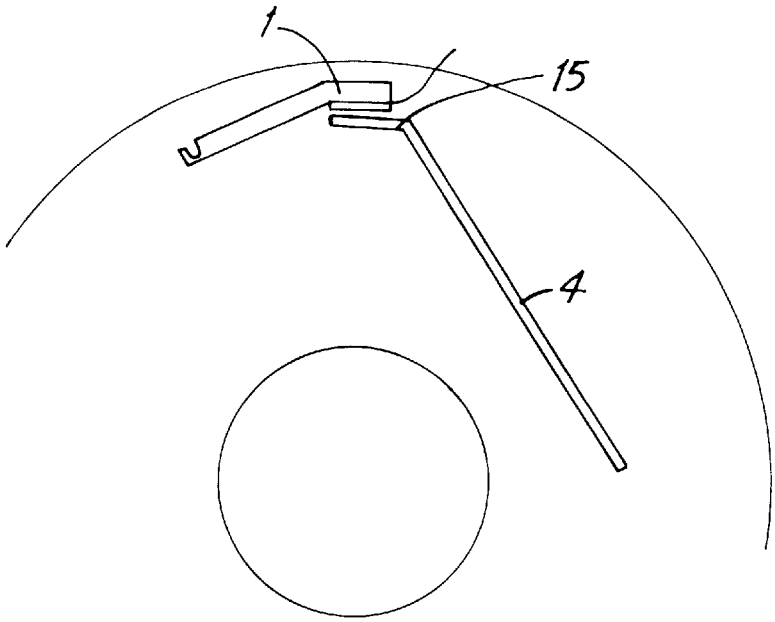
Figure 15:
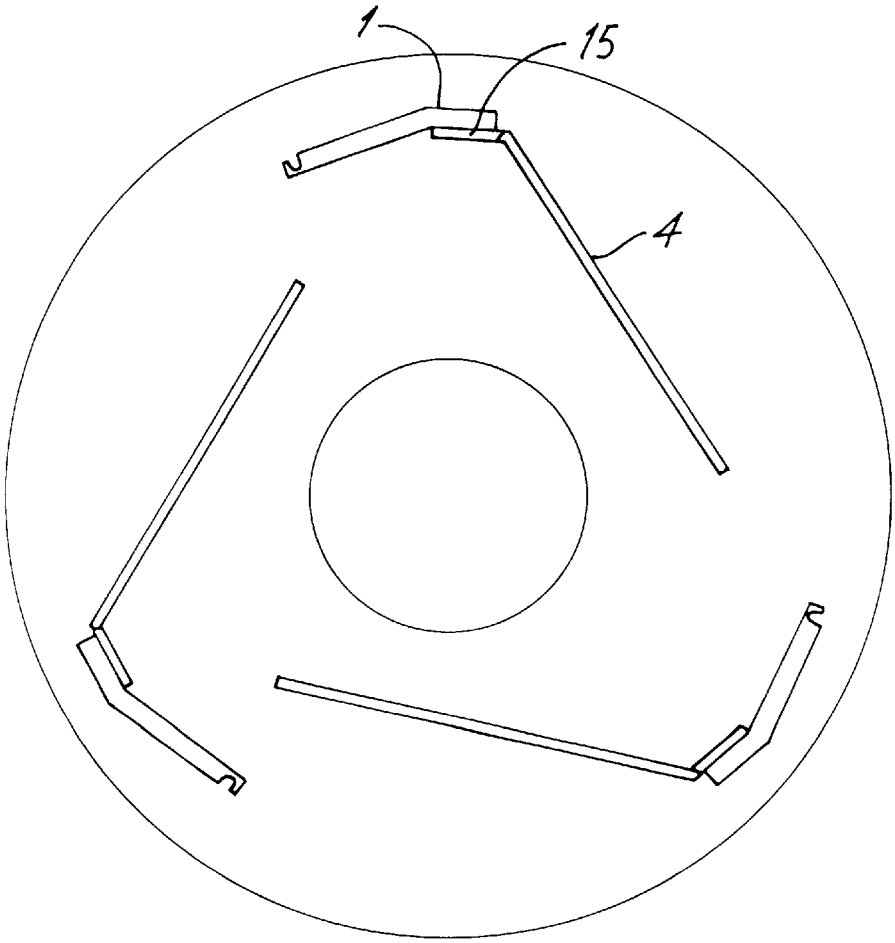
Figure 16A:
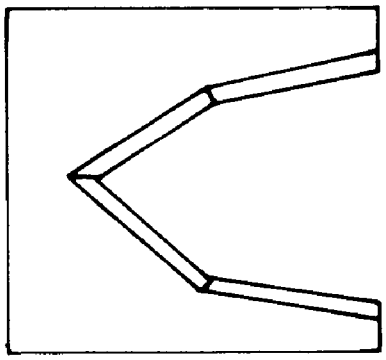
Figure 16B:
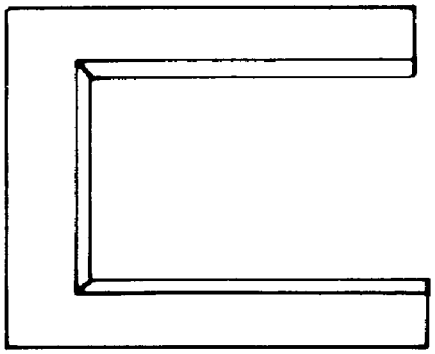

FIG. 8 is a plan view of part of a rotor assembly illustrating the material build-up profile 6 and material flow path 7 and exit angle 8 as well as the tip assembly and its angular disposition to the material build-up 6 and flow path 7;

FIG. 9 is a view of the assembly of FIG. 8 wherein the spacers have been removed to change the angular disposition and position of the tip assembly to the rotor assembly;

FIG. 10 is a view as per FIG. 9 wherein indexing means 9 are illustrated into which part of the tip assembly is able to index with;

FIG. 11 illustrates the prior art tip of FIG. 3 in a plan view wherein the tip assembly is rotated inwardly;

FIG. 12 shows the tip assembly of FIG. 11 rotated outwardly wherein the tip radius X has increased and the angle between the material bed and the weir tip B does not equal the angle A of FIG. 11 when the tip assembly is rotated inwardly;

FIG. 13 shows a tip assembly mounted on a 4-bar chain mechanism which allows for movement of the tip assembly relative to the rotor axis, as an alternative to the use of spacers;

FIGS. 14 and 15 show a tip assembly in accordance with the present invention in the context of an overall rotary mineral breaker; and FIGS. 16A and 16B show variations of the first component (or indeed even the presented weir-like exit defined by the tip assembly).

The present invention consists in rotary mineral breaker tips in or for a rotary mineral breaker 10 shown in part in FIGS. 4–10 and more completely in FIG. 15.

Minerals or rocks which enter the rotary mineral breaker substantially in the middle to form a bed of mineral pieces (eg. of rocks and/or minerals) on a bed support of the rotor. Subsequent material travels to the outermost region of the rotary mineral breaker over the accumulated bed of mineral pieces and over a wear tip or tips of a tip assembly presenting edge region(s) of a wear resistant material before leaving the rotary mineral breaker. In our PCT application PCTNZ94/00111 there is described such a rotary mineral breaker which also further describes the use of a weir-like edge region which provides additional improvements and enhancements to the flow of material through the rotary mineral breaker.

With reference to the present invention a bed of mineral pieces accumulates on a bed support 4 and against or inwardly of a tip assembly 1. As shown in FIGS. 8–10 the retained bed of mineral pieces forms a material buildup profile 6.

Although in the FIGS. 4–10 and 13, 14 of the present invention there is illustrated only one material flow chamber, a person skilled in the art will appreciate that several such chambers may be placed within the rotor to provide several retained beds of mineral pieces over which material is able to flow before exiting. This is shown in FIG. 15.

The tip assembly 1 of the present invention preferably consisting of a first component 12 and a second component 14 either of which or both provide a wear resistant tip or tips having wear resistant edges. The tip assembly further includes a position modifying means which will hereinafter be described in more detail.

Material travelling through the rotary mineral breaker 10 will tend to follow a flow path 7 over the material buildup profile 6 and over the wear resistant tip(s) 5 prior to exiting the rotary mineral breaker along an exit path 8 (or 8') or similar.

Figure 4:
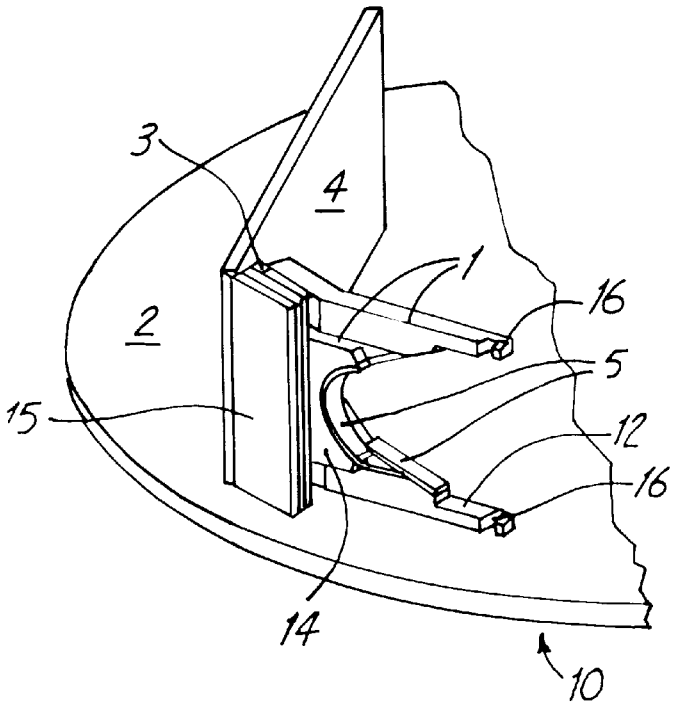
FIG. 4 illustrates a tip assembly 1 which is located relative to the rotor assembly 2 using inserts of a wedged configuration which allow for the minimal change in angle whilst allowing the distance from tip to the outside edge of the rotor to be varied.
Figure 5:
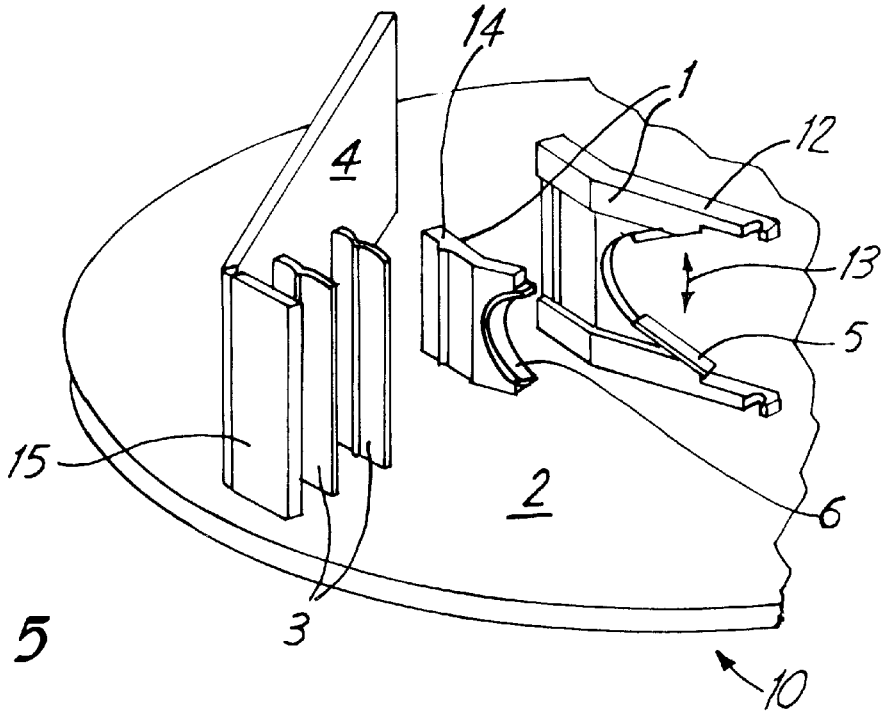
FIG. 5 is an exploded view of the components of FIG. 4.
Figure 6:
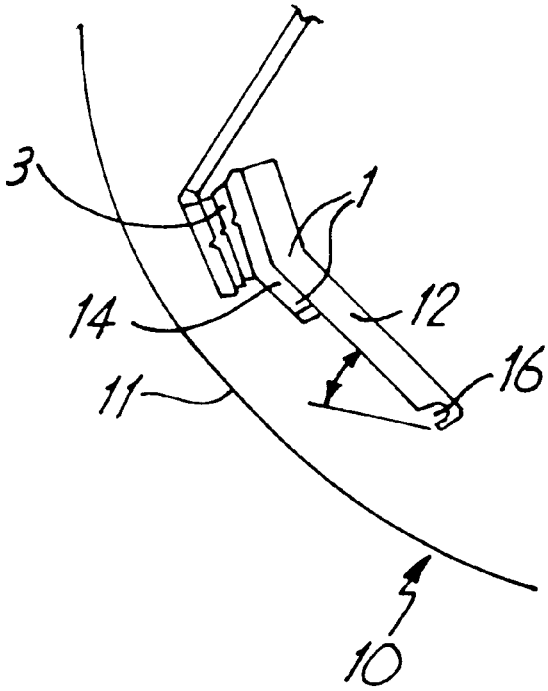
FIG. 6 is a plan view of the components of FIG. 4.
Figure 7:
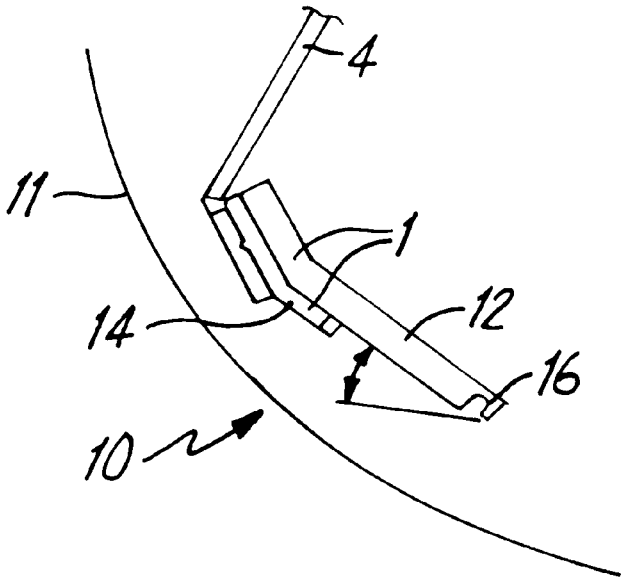
FIG. 7 is a plan view of a tip assembly wherein the spacers have been removed to change the angle and position of the tip assembly.

In the preferred form of the invention the tip assembly 1 presents a wear resistant tip or tips 5 best shown in FIGS. 4 and 5. The second component of the tip assembly provides said wear resistant tip(s) and preferably the first component also provides a wear resistant tip(s). The wear resistant tip or tips 5 are preferably made of a hardened material such as tungsten carbide. A person skilled in the art will realise that many other suitable hard or hardened materials may be used as a wear resistant tip(s) in the tip assembly of the rotary mineral breaker of the present invention.

The second component or assembly of the wear resistant tip providing component preferably presents the wear resistant tip 5 as a weir-like edge region as shown in FIG. 5. Preferably the first component is also provided with wear resistant tip(s) 5. The spaced edges (preferably wear resistant tips 5) of the first component define a gap which together with the weir-like edge region of the second component define an overall weir-like arrangement of the assembly. Such a weir-like arrangement may be in the shape of a general "U" or "V" like shape or may be of a polygon like recess and need not necessarily be symmetrical.

FIGS. 16A and 16B show options for the first component "gap" or indeed the overall weir-like gap of the assembly. The gap can be complex, multi-part and/or asymmetric.

Material flowing from the rotary mineral breaker will have passed over the wear resistant tip(s) 5 through the gap prior to leaving the rotary mineral breaker.

Different materials flowing through the rotary mineral breaker will have different paths of exit (eg. 8 and 8'). To protect the exterior of the rotor 11 from high speed movement of abrasive minerals relative thereto, the clearance distance (which is denoted in FIGS. 9 and 10 by Y) between the tip assembly 1 (and particularly the wear resistant tip) and the exterior of the rotor 11 needs to be variable to ensure that the material exiting from the rotor exits is at an optimal path. The tip assembly of FIGS. 11 and 12 (prior art) achieves such reposition ability of the edge of the wear resistant tip by providing a pivot about which the tip assembly is able to rotate. This however alters the angle (A' and B') of the edge of wear resistant tip 5 relative to the material build up profile 6. It will also alter the build up profile and wear characteristics of the edge and does not allow for the modification of angle and position of the tip without changing wear characteristics.

The present invention provides a tip assembly which presents an edge of a wear resistant tip 5 (whether weir-like, straight or other in profile) which is able to be positioned within a rotary mineral breaker and by the provision of a position modifying means allows for at least one (and preferably both) of (a) the angular disposition of the edge presented by the wear resistant tip of the assembly relative to material build up and hence the mineral piece(s) pathway, bed support and/or rotor radius, and (b) the position of the edge presented by the wear resistant tip relative to the rotor axis and hence the outside edge of rotor to be modified to allow the tuning of the tip assembly for the conditions of operation of the breaker.

As shown in FIGS. 8 and 9 the preferred position modifying means 3 (preferably a spacer or insert or an assembly of inserts) may modify the clearance Y without substantially changing the angle of the wear resistant tip 5 relative to the material build up profile 6 at or towards the wear resistant tip 5. The position modifying means 3 in a preferred form of the present invention consists of spacers which are able to be located between the body of the rotary mineral breaker directly or via, for example, a holder, locator or mounting plate or an extension of the bed support and the second component. A plurality of such spacers may be assembled to provide the desired variability in the angular position or displacement of the wear tip resistant relative to the rotor axis of the rotary mineral breaker. Preferably the spacers are wedge shaped and are adapted or positioned to tend to move the edge presented by the wear resistant tip radially with respect to the rotary axis and angularly rotate the edge presented by the wear resistant tip so as to maintain a similar or the same angle with the flow of material there over and yet not to change substantially the profile 6.

The preferred wedge shaped spacers or an assembly of spacers displace the surface or surfaces of mounting the tip assembly (or component thereof) towards the axis of the rotor yet displace the edge presented by the wear resistant tip away from the rotary axis.

Alternatives to the use of a spacer or assembly of spacers are envisaged. As an example it is envisaged that a tip assembly may be secured using a 4-bar chain mechanism which locates the tip assembly between the free pivoting ends (20, 21) about fixed ends (22, 23) of the known 4-bar chain mechanism as shown in FIG. 13. A person skilled in the art will understand that the correct selection of the 4-bar chain geometry will allow for similar characteristics of wear resistant tip movement as for those achieved by the inserts.

Figure 1:
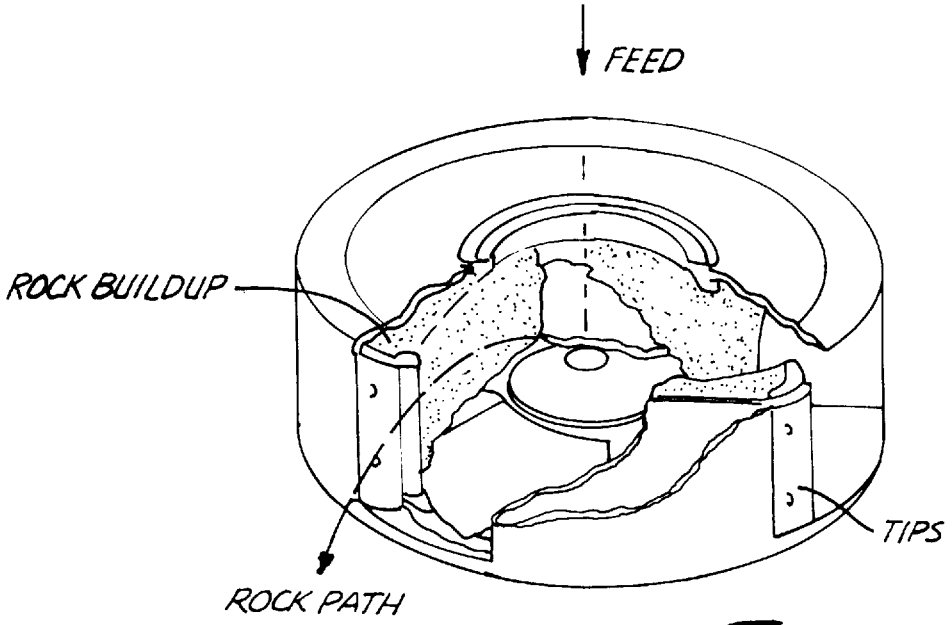
Fig. 1 PRIOR ART
FIG. 1 shows the feed direction (axially with respect to the loader), the flow direction after movement into a retained mineral bed and the circumferential or radial exiting from the rotor over a wear tip of a prior art mineral breaker.
Figure 2:
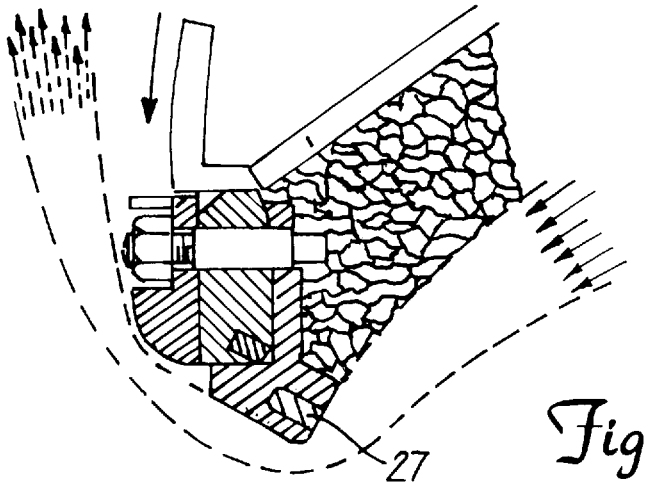
Fig. 2 PRIOR ART
FIG. 2 shows a wear tip 27 which is securely fixed to the embodiment of a prior art rotary mineral breaker and also illustrates in part the bed of retained material.

In the most preferred form of the present invention the tip assembly 1 consists of a first component 12 which provides spaced apart edges to preferably define a gap 13 and a second component 14 which may co-act as an assembly with the first component to present across the gap the preferred weir-like region as a wear tip(s) of a wear resistant material such as tungsten carbide. Most preferably the second component is assembled outermost relative to the first component when in said mineral breaker or alternatively the second component may be innermost relative to the first component. A person skilled in the art will appreciate that the first and second component may be made of a unitary member and although herein described as being preferable weir shaped, the edge presented by the tip component may be straight as for example shown in the non-adjustable prior art configuration in FIG. 1.

The tip assembly is preferably locatable to the rotor body by the position modifying means to a mounting means or holder or mounting region 15. Preferably the securement of the tip assembly is achieved by a suitable securing or locating means. Persons skilled in the art will appreciate that such means may include bolts, bolt and nut combination, machine screws, locator pins or regions suitable clamping means or any other suitable securing means.

In the preferred form of the present invention the rotary mineral breaker includes several tip assemblies (one each for each chamber) located towards the perimeter of the rotary mineral breaker body as shown in FIG. 15. Preferably each of said tip assemblies will include components as herein described to allow the position of the tip assemblies to be modified.

The tip assembly and position modifying means are located within the rotary mineral breaker between upper and lower members of the rotor. FIGS. 4 and 5 show only in part one of the lower or upper member 2 of the rotor but it will be appreciated that the upper member will be located so as to enclose the tip assembly and position modifying means and bed support within the rotor to provide a material flow chamber(s).

In a preferred form of the present invention as shown in FIGS. 4 and 5 the first component 12 has extending therefrom on each side of the gap, engaging means 16 to index with indexing means 9 shown in FIG. 10 to provide stability and location of the tip assembly 1 relative to the rotor.

Preferably the engaging means which are at or towards the open end of the gap defined by spaced apart edges of the first component are reliefs or may alternatively be apertures into which the indexing means 9 are selectively able to locate. In the preferred form the engaging means 16 present reliefs which when in use are directed with their opening radially outwardly so that when engaged with an indexing means, the forces of the materials flowing outwardly from the rotor will force the tip assembly against the indexing means.

The indexing means of the preferred form are a series of pins or upstands from both the upper and lower members of the rotor. Preferably the upstands on the lower member correspond geometrically with the pins or upstands on the upper member.

Alternatively the engaging means 16 may be apertures through the tip assembly into which pins or bolts extending from or extendible from the upper and lower members are able to be inserted and may additionally be secured by threaded regions thereof to the tip assembly. In an alternative form of the invention the tip assembly (which includes the preferred first and second component as an assembly) may not necessarily need to be secured to the mounting 15 by the use of securing means such as bolts or screws.

Such securing means may not necessarily be required as the centrifugal forces and material build up may provide sufficient radial force to maintain contact between the tip assembly 1 and the mounting plate 15. Locating means may still be necessary.

The present invention also provides as replacement parts or as an upgrading to existing rotary mineral breakers, a tip assembly and/or position modifying means separately or in combination.

What is claimed is:

1. A tip assembly for the rotor of a rotary mineral breaker of a kind comprising said rotor rotatable about a substantially vertical axis and having material infeed means orientated in the direction of the vertical axis, radial discharge regions positioned remotely from the vertical axis, said tip assembly mounted inwardly from each said discharge regions such that, in use, a bed of mineral pieces accumulates on a bed support of the rotor and against or inwardly of the tip assembly and over which bed and tip assembly mineral pieces move to be free of the rotor, said tip assembly comprising:

a wear resistant tip providing component providing a wear resistant edge region over which the majority of the mineral pieces in use being moved over the bed and then over the top assembly will tend to move prior to exiting said rotor through said discharge region, and position modifying means to allow the independent repositioning of the wear resistant edge region of the wear resistant tip providing component (i) in its angular disposition across and under the mineral pieces to move thereover, and (ii) in the radial position relative to the rotor axis.

2. A tip assembly as claimed in claim 1 wherein said wear resistant edge region of said wear resistant tip providing component has a shape that is straight, scalloped, or weir-like.

3. A tip assembly as claimed in claim 2 wherein said wear resistant tip providing component is an assembly comprising a first component mounted to said position modifying means, and a second component to co-act with said first component, said first and second components being shaped to define a weir-shape to said wear resistant edge region.

4. A tip assembly as claimed in claim 2 wherein said position modifying means is releasably engaged to a fixed mounting region of said rotor and has engagement regions to releasably engage and secure said wear resistant tip providing component therewith.

5. A tip assembly as claimed in claim 1 wherein said wear resistant tip providing component is an assembly comprising a first component mounted to said position modifying means, and a second component to co-act with said first component, said first and second components being shaped to define a weir-shape to said wear resistant edge region.

6. A tip assembly as claimed in claim 5 wherein said second component has a substantially "U" or "V" shaped edge region and said first component defines part of the wear resistant edge region as at least two spaced edges which extend from the distal ends of the substantially "U" or "V" shaped edge region of said second component.

7. A tip assembly as claimed in claim 6 wherein said position modifying means is releasably engaged to a fixed mounting region of said rotor and has engagement regions to releasably engage and secure said wear resistant tip providing component therewith.

8. A tip assembly as claimed in claim 5 wherein said position modifying means is releasably engaged to a fixed mounting region of said rotor and has engagement regions to releasably engage and secure said wear resistant tip providing component therewith.

9. A tip assembly as claimed in claim 1 wherein said position modifying means is releasably engaged to a fixed mounting region of said rotor and has engagement regions to releasably engage and secure said wear resistant tip providing component therewith.

10. A tip assembly of claim 9 wherein said position modifying means is at least one spacer to interpose between said fixed mounting region of said rotor and said wear resistant tip providing component.

11. A tip assembly of claim 10 wherein there is a plurality of said spacers to define a stack of spacers to allow a suitable position modifying means for different positioning of said wear resistant tip providing component.

12. Position modifying means to allow the repositioning of a tip assembly of a rotary mineral breaker of a kind comprising a rotor rotatable about a substantially vertical axis and having material infeed means orientated in the direction of the vertical axis, radial discharge regions being positioned remotely from the vertical axis, said tip assembly providing a wear resistant edge region mounted inwardly from each said discharge regions such that, in use, a bed of mineral pieces on a bed support of the rotor and against or inwardly of said tip assembly and over which tip assembly and wear resistant edge region, mineral pieces move to be free of the rotor, said position modifying means comprising:

at least two spacers assembled to be interposable as an assembly between said tip assembly and the rotor of said rotary mineral breaker, the spacers being selectable to define a desired shape as an assembly to independently reposition said wear resistant edge region for subsequent use, (a) in the angular disposition relative to said rotor, and (b) in the position relative to the rotor axis.

13. Position modifying means as claimed in claim 12 wherein each said spacer can engage with each other to allow at least two different shaped spacer assemblies to be defined.

14. A rotary mineral breaker comprising:

a rotor rotatable about a substantially vertical axis and having material infeed means orientated in the direction of the vertical axis, radial discharge regions being positioned remotely from the vertical axis, a tip assembly mounted on said rotor inwardly from each said discharge regions such that, in use, a bed of mineral pieces accumulates on a bed support of the rotor and against or inwardly of said tip assembly and over which bed and tip assembly mineral pieces move to be free of the rotor, wherein each tip assembly for each bed support of the rotor includes a wear resistant tip providing component having a wear resistant edge region providing a weir-like edge over which the majority of the mineral pieces are to move in exiting the rotor, said edge being adjustable in respect to (1) its position relative to the rotor axis, and (2) the angular disposition of the weir-like edge relative to at least one of (a) the pathway of migration of pieces over said weir-like edge, (b) the bed support for the bed of mineral pieces, and (c) the radius of the rotor, the adjustments (1) and (2) can be achieved without adjustment of one necessarily resulting in a change of the other.

15. A method tuning a tip assembly of a rotary mineral breaker of a kind comprising a rotor rotatable about a substantially vertical axis and having material infeed means orientated in the direction of the vertical axis, radial discharge regions being positioned remotely from the vertical axis, said tip assembly mounted inwardly from each said discharge regions such that, in use, a bed of mineral pieces accumulates on a bed support of the rotor and against or inwardly of said tip assembly and over which bed and tip assembly mineral pieces move to be free of the rotor, said method comprising spacing said rotor mounted or mountable tip assembly using position modifying means of a selected shape whereby the wear resistant edge region is independently adjusted in respect to (1) its position relative to the rotor axis, and (2) the angular disposition of the wear resistant edge region relative to at least one of (a) the pathway of migration of pieces over said edge region, (b) bed support for the bed of mineral pieces, and (c) the radius of the rotor, the adjustments (1) and (2) able to be made without adjustment of one necessarily resulting in a change of the other.

* * * * *